US011555351B2

(12) United States Patent
Jia et al.

(10) Patent No.: US 11,555,351 B2
(45) Date of Patent: Jan. 17, 2023

(54) SPIRAL IMPACT DRILLING MACHINE APPLICABLE TO ROCK AND SOIL AND CONSTRUCTION METHOD

(71) Applicant: DALIAN UNIVERSITY OF TECHNOLOGY, Dalian (CN)

(72) Inventors: Jinqing Jia, Dalian (CN); Lihua Zhang, Dalian (CN); Xing Gao, Dalian (CN); Xiangsheng Chen, Dalian (CN); Xiaoping Liao, Dalian (CN); Xuchun Wang, Dalian (CN); Yanpeng Zhu, Dalian (CN); Tonghe Zhou, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 17/495,475

(22) Filed: Oct. 6, 2021

(65) Prior Publication Data

US 2022/0154532 A1 May 19, 2022

(30) Foreign Application Priority Data

Nov. 19, 2020 (CN) ..... 202011300309.4

(51) Int. Cl.

| | |
|---|---|
| ***E21B 6/04*** | (2006.01) |
| ***E21B 1/30*** | (2006.01) |
| ***E21B 1/38*** | (2006.01) |
| ***E21B 10/44*** | (2006.01) |

(52) U.S. Cl.

CPC ..... *E21B 6/04* (2013.01); *E21B 1/38* (2020.05); *E21B 10/445* (2013.01)

(58) Field of Classification Search

CPC ..... E21B 6/00; E21B 6/08; E21B 6/04; E21B 1/30; E21B 1/38; E21B 1/14; E21B 3/03; B25D 16/00; B25D 16/003; B25D 16/006

See application file for complete search history.

(56) References Cited

U.S. PATENT DOCUMENTS

| | | | | |
|---|---|---|---|---|
| 3,786,874 A * | 1/1974 | Jodet | E21B 7/24 | 173/28 |
| 5,409,070 A * | 4/1995 | Roussy | E21B 7/24 | 175/55 |
| 5,415,240 A * | 5/1995 | Mundjar | B25D 9/22 | 173/206 |
| 2011/0240322 A1* | 10/2011 | Kandelin | B25D 9/14 | 173/104 |

(Continued)

*Primary Examiner* — Kipp C Wallace

(74) *Attorney, Agent, or Firm* — Brooks Kushman, P.C.

(57) ABSTRACT

A spiral impact drilling machine applicable to rock and soil and a construction method are provided. The drilling machine includes a rock chiseling part, a soil drilling part, a gear, a drill rod, and a drill bit. The rock chiseling part includes an air cylinder. A piston is arranged in the air cylinder. The top of the piston is fixedly connected with to a turbine fan blade. The bottom of the piston is fixedly connected to a force transferring component. The soil drilling part includes a motor. The motor is arranged in the force transferring component. The inner part of the gear is in nested connection with the drill rod. The outer part of the gear is in engaged connection with each of the bottom of the force transferring component and the motor. The bottom of the gear is fixedly connected to the drill rod through a stress component.

7 Claims, 2 Drawing Sheets

(56) References Cited

U.S. PATENT DOCUMENTS

| | | | | |
|---|---|---|---|---|
| 2012/0292114 | A1* | 11/2012 | Keskiniva | E21B 6/00 175/57 |
| 2013/0292179 | A1* | 11/2013 | Pikowski | E21B 6/04 175/56 |
| 2014/0083775 | A1* | 3/2014 | Tang | E21B 7/002 175/56 |
| 2014/0332278 | A1* | 11/2014 | West | E21B 10/36 175/57 |
| 2016/0084005 | A1* | 3/2016 | Kuzma | E21B 6/04 173/105 |

* cited by examiner

SPIRAL IMPACT DRILLING MACHINE APPLICABLE TO ROCK AND SOIL AND CONSTRUCTION METHOD

CROSS REFERENCE TO RELATED APPLICATION

This application claims foreign priority benefits under 35 U.S.C. § 119(a)-(d) to CN Application No. 202011300309.4, filed on Nov. 19, 2020, which is hereby incorporated by reference in its entirety.

TECHNICAL FIELD

The present disclosure belongs to the technical field of geotechnical engineering, and particularly, relates to a spiral impact drilling machine applicable to rock and soil and a construction method.

BACKGROUND ART

Anchor bolt support is a common support form in the field of geotechnical engineering. Usually, a spiral drilling machine is used for drilling a soil stratum, and an impact down-the-hole is used for drilling a rock stratum to form a hole. In practical engineering, complex strata with both soil stratum and rock stratum are often encountered. A conventional solution to such problems is to replace drilling equipment. However, such solutions have the following problems: (1) a large amount of time is spent in replacing, transporting, assembling, and checking machines, tools, and equipment, so as to increase the construction period. (2) Different drilling equipment is replaced according to different stratum conditions, which increases engineering cost intangibly. (3) Hole position deviation and hole inclination are easily caused by replacement and displacement of the machines and tools.

SUMMARY

In view of the above-mentioned technical problems, the present disclosure aims to provide a spiral impact drilling machine and a construction method, which is applicable to a stratum with alternating strata of soil and rock, high in drilling efficiency, wide in adaptation range, convenient, quick, and easy to operate.

The technical solution adopted by the present disclosure is that:

A spiral impact drilling machine applicable to rock and soil includes a power distribution system, an air compression system, a rock chiseling part, a soil drilling part, a gear, a drill rod, and a drill bit at the bottom of the drill rod. The rock chiseling part includes an air cylinder. An air pipe is arranged at the top of the air cylinder. A hole is formed in the bottom of the air cylinder. A piston is arranged in the air cylinder. The top of the piston is fixedly connected with to a turbine fan blade. The bottom of the piston is fixedly connected to a force transferring component. The soil drilling part includes a soil drilling shell and a motor. The force transferring component is arranged in the soil drilling shell, and the motor is arranged in the force transferring component. The inner part of the gear is in nested connection with the drill rod. The outer part of the gear is in engaged connection with each of the bottom of the force transferring component and the motor. The bottom of the gear is fixedly connected to the drill rod through a stress component. The drill bit includes a spiral drill bit. The bottom of the spiral drill bit is connected to a high-strength rock chiseling drill bit, which not only meets a rotary excavating function of soil stratum drilling, but also meets an impact rock chiseling function of rock stratum drilling.

The drill rod is assembled and lengthened by using splicing connection, for example, is assembled and lengthened by threaded connection. The drill rod is combined and spliced according to a drilling depth, so as to meet a requirement on hole depth.

The top of the piston is fixedly connected to a shaft or fan blades of the turbine fan blade.

The bottom of the drill rod is connected with the drill bit through screw threads. Further, the drilling machine further includes a dismounting device, for example, a wrench, matched with the drill bit. The drill bit is engaged with the dismounting device, and the drill rod and the drill bit are automatically dismounted by controlling the drill rod to rotate in an opposite direction.

A rock chiseling shell is also arranged outside the air cylinder. The rock chiseling shell is connected to the soil drilling shell by bolts.

There is one gear, or there may be an upper gear and a lower gear. The outer part of the upper gear is engaged with the motor. The outer part of the lower gear is engaged with the bottom of the force transferring component. The bottom of the lower gear is fixedly connected to the drill rod through the stress member. Preferably, there is one gear.

The present disclosure further provides a construction method for a spiral impact drilling machine applicable to rock and soil. When the high-strength rock chiseling drill bit is in contact with a soil stratum, the motor is started. The motor drives the spiral drill bit and the high-strength rock chiseling drill bit to rotate through the rotation of the drill rod, so as to drill a hole. When the high-strength rock chiseling bit is in contact with a rock stratum, the air compression system (pumping in or pumping out air) controls the turbine fan blade to drive the piston to rotate through the air pipe, and simultaneously controls the piston to move up and down, so that the force transferring component drives the drill rod to rotate, drives the spiral drill bit and the high-strength rock chiseling drill bit to rotate, and simultaneously transfers an impact load to the stress component. The high-strength rock chiseling drill bit is driven to rotate and chisel the rock through the drill rod.

Preferably, the air compression system controls, through the air pipe, the turbine fan blade to drive the piston to rotate at a low frequency.

The present disclosure has the following beneficial effects:

(1) The spiral impact drilling machine can be adapted to different stratum conditions, and is particularly applicable to a stratum with alternating strata of soil and rock. The drilling machine can adopt different drilling modes according to different stratum conditions. When a soil stratum is encountered, a rotary excavating mode may be adopted for drilling; and when a hard rock stratum is encountered, an impact rock chiseling mode may be adopted for drilling.

(2) The spiral impact drilling machine is environment-friendly, energy-saving, and noise-reducing. The rock chiseling part takes compressed air as a power source, does not have a harmful product, and is energy-saving, and environment-friendly. Meanwhile, the work efficiency of the rock chiseling part is high.

(3) Free switching between hole drilling and hole chiseling of equipment is realized. The motor is adopted for controlling during equipment drilling. When the drill bit works in a soil body, the drill bit is controlled to rotate for drilling through the motor. When the drill bit works in rock, the piston is controlled to move up and down through an air pump, so as to realize rock chiseling work. Under the action of the air pump, the turbine fan blade at the upper end of the piston drives the piston to rotate at a low frequency, so as to drive the drill bit to rotate at a low speed, so that the drill bit chisels more uniformly.

(4) Motor drills holes stably and can provide a proper torque. When the soil body is drilled, the rock does not need to be chiseled for forming a hole. Then, the motor drives the drill rod to rotate. Compared with controlling the drill rod to rotate by the air pump or hydraulic pressure, the rotating frequency of the motor is more stable. Meanwhile, the motor can provide a torque that meets a drilling requirement, and the torque provided by the air pump or the hydraulic pressure is limited.

(5) A transmission system is stable and firm. The present disclosure develops a novel force transferring component and a novel stress component to form a new transmission system. The force transferring component and the stress component are combined to use, and two working states can be perfectly divided, so that drilling in soil and chiseling in rock are independently carried out, and no correlation is generated between the two working states. Meanwhile, the combination of the force transferring component and the stress component greatly plays an important role in stabilizing the drill rod.

(6) The drill bit and the drill rod are assembled and disassembled automatically. The drill bit and the drill rod may be assembled and disassembled automatically by arranging a dismounting device matched with the drill bit. The drilling rod rotates in a positive direction, and the drill bit is fastened to the drill rod. The drill rod rotates in a reverse direction, and the drill bit and the drill rod are loosened, which can facilitate the disassembling of the drill bit and the drill rod.

(7) The drill bit is solid and firm. The drill bit directly acts with a rock-soil body during drilling, so that the drill bit is the weakest part of the drilling machine. The drill bit in the present disclosure is a combined drill bit of the spiral drill bit and the high-strength rock chiseling drill bit, which meets the requirements of rotary excavating and impact rock chiseling, and cannot be damaged during drilling.

(8) The rock is chiseled uniformly. Due to the fact that the turbine fan blade is arranged at the upper end of the piston, when air is pumped in or pumped out, the force transferring component drives the drill rod to rotate, and the high-strength rock drilling bit rotates during impact rock chiseling, so that the holes chiseled in the rock are more uniform.

Reference signs in drawings: 1—air cylinder; 2—air pipe; 3—piston; 4—turbine fan blade; 5—force transferring component; 6—motor; 7—stress component; 8—drill rod; 9—gear; 10—screw threads; 11—spiral drill bit; and 12—high-strength rock chiseling drill bit.

DETAILED DESCRIPTION

It should be understood that orientations or positional relationships indicated by the terms "length", "width", "upper", "lower", "front", "rear", "left", "right", "vertical", "longitudinal", "horizontal", "top", "bottom", "inside", "outside", etc. are the orientations or positional relationships shown based on the accompanying drawings, and are merely for facilitating describing the present disclosure and simplifying the description, rather than indicating or implying that the devices or elements must have particular orientations, and be constructed and operated in particular orientations. Thus, it cannot be construed as a limitation to the present disclosure.

Embodiment 1

Figure 1:
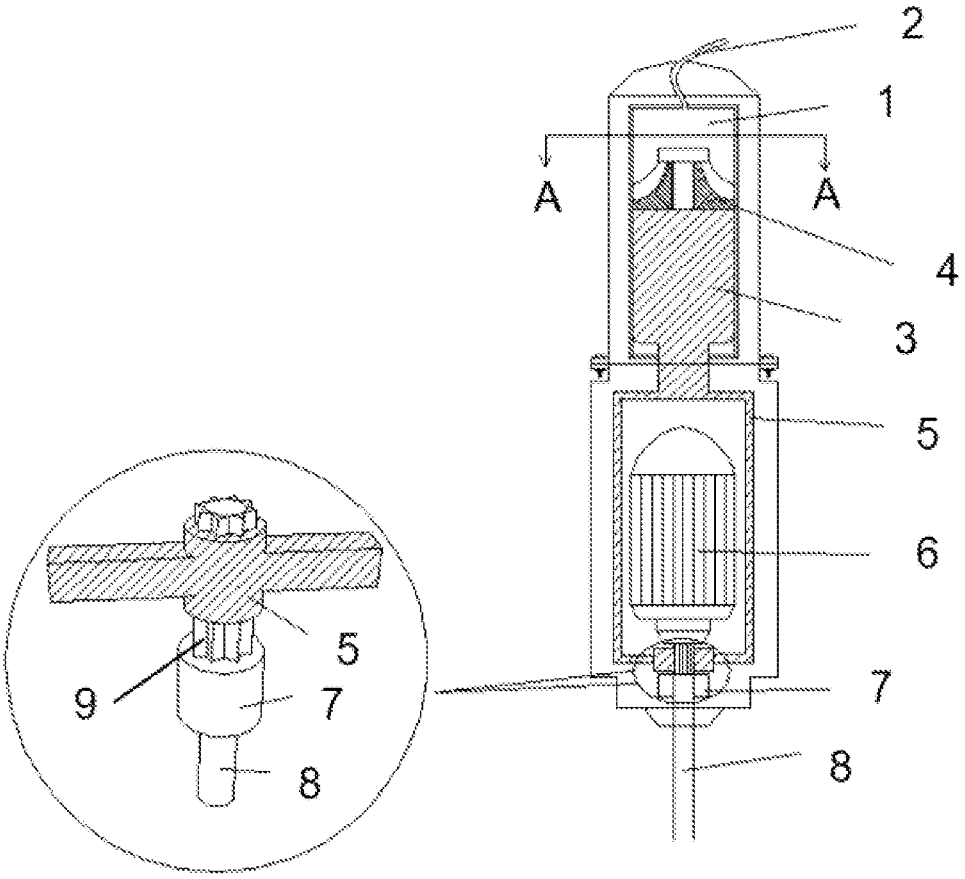
FIG. 1 is a schematic diagram of interiors of a rock chiseling part and a soil drilling part of the present disclosure.
Figure 2:
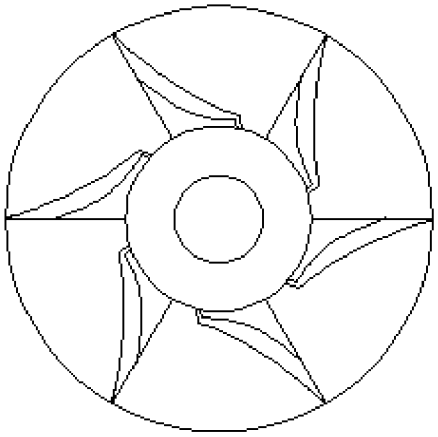
FIG. 2 is an A-A sectional view.
Figure 3:
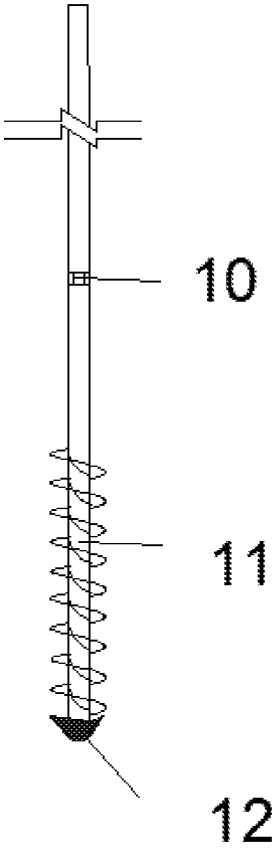
FIG. 3 is a schematic diagram of a drill rod and a drill bit.

As shown in FIG. 1 to FIG. 3, a spiral impact drilling machine applicable to rock and soil includes a power distribution system, an air compression system, a rock chiseling part, a soil drilling part, a gear 9, a drill rod 8, and a drill bit at the bottom of the drill rod. The rock chiseling part includes a rock chiseling shell, an air cylinder 1. An air pipe 2 is arranged at the top of the air cylinder 1. A hole is formed in the bottom of the air cylinder 1. A piston 3 is arranged in the air cylinder 1. The top of the piston 3 is fixedly connected with to a shaft of a turbine fan blade 4. The bottom of the piston 3 is fixedly connected to a force transferring component 5. The soil drilling part includes a soil drilling shell and a motor 6. The force transferring component 5 is arranged in the soil drilling shell, and the motor 6 is arranged in the force transferring component 5. The inner part of the gear 9 is in nested connection with the drill rod 8. The outer part of the gear 9 is in engaged connection with the bottom of the force transferring component 5 and the motor 6. The bottom of the gear 9 is fixedly connected to the drill rod 8 through a stress component. The drill bit includes a spiral drill bit 11. The bottom of the spiral drill bit 11 is connected to a high-strength rock drilling drill bit 12.

The drill rod is connected and lengthened through screw threads 10. The drill rod is combined and assembled according to a drilling depth, so as to meet a requirement on hole depth.

The bottom of the drill rod 8 is connected to the drill bit 11 through the screw threads 10. The drilling machine further includes a dismounting device matched with the drill bit. The spiral drill bit 11 is engaged with the dismounting device, and the drill rod and the drill bit are automatically dismounted by controlling the drill rod to rotate in an opposite direction.

The rock chiseling shell is connected to the soil drilling shell by bolts.

During work, when the high-strength rock chiseling drill bit 12 is in contact with a soil stratum, the motor 6 is started. The motor 6 drives the spiral drill bit 11 and the high-strength rock chiseling drill bit 12 to rotate through the rotation of the drill rod 8, so as to drill a hole. When the high-strength rock chiseling bit 12 is in contact with a rock stratum, the air compression system (pumping in or pumping out air) controls the turbine fan blade 4 to drive the piston 3 to rotate through the air pipe 2, and simultaneously controls the piston 3 to move up and down, so that the force transferring component 5 drives the drill rod 8 to rotate, drives the spiral drill bit 11 and the high-strength rock chiseling drill bit 12 to rotate, and simultaneously transfers an impact load to the stress component 7. The high-strength rock chiseling drill bit 12 is driven to rotate and chisel the rock through the drill rod 8.

What is claimed is:

1. A spiral impact drilling machine applicable to rock and soil, comprising an air compression system, a rock chiseling part, a soil drilling part, a gear, a drill rod, and a drill bit at a bottom of the drill rod, wherein the rock chiseling part comprises an air cylinder; an air pipe is arranged at a top of the air cylinder; a hole is formed in a bottom of the air cylinder; a piston is arranged in the air cylinder; a top of the piston is fixedly connected to a turbine fan blade; a bottom of the piston is fixedly connected to a force transferring component; the soil drilling part comprises a soil drilling shell and a motor; the force transferring component is arranged in the soil drilling shell, and the motor is arranged in the force transferring component; an inner part of the gear is in nested connection with the drill rod; an outer part of the gear is in engaged connection with each of a bottom of the force transferring component and the motor; a bottom of the gear is fixedly connected to the drill rod through a stress component; the drill bit comprises a spiral drill bit; and the bottom of the spiral drill bit is connected to a high-strength rock chiseling drill bit.

2. The spiral impact drilling machine applicable to rock and soil according to claim 1, wherein the drill rod is assembled and lengthened by threaded connection.

3. The spiral impact drilling machine applicable to rock and soil according to claim 1, wherein the bottom of the drill rod is connected with the drill bit through screw threads; the drilling machine further comprises a dismounting device matched with the drill bit; and the drill bit is engaged with the dismounting device, and the drill rod and the drill bit are automatically dismounted by controlling the drill rod to rotate in an opposite direction.

4. The spiral impact drilling machine applicable to rock and soil according to claim 1, wherein a rock chiseling shell is also arranged outside the air cylinder; and the rock chiseling shell is connected to the soil drilling shell by bolts.

5. The spiral impact drilling machine applicable to rock and soil according to claim 1, wherein there is one gear.

6. A construction method for the spiral impact drilling machine applicable to rock and soil according to claim 1, wherein when the high-strength rock chiseling drill bit is in contact with a soil stratum, the motor is started; the motor drives the spiral drill bit and the high-strength rock chiseling drill bit to rotate through rotation of the drill rod so as to drill a hole; when the high-strength rock chiseling bit is in contact with a rock stratum, the air compression system controls the turbine fan blade to drive the piston to rotate through the air pipe, and simultaneously controls the piston to move up and down, so that the force transferring component drives the drill rod to rotate, drives the spiral drill bit and the high-strength rock chiseling drill bit to rotate, and simultaneously transfers an impact load to the stress component; and the high-strength rock chiseling drill bit is driven to rotate and chisel the rock through the drill rod.

7. The construction method for the spiral impact drilling machine applicable to rock and soil according to claim 6, wherein the air compression system controls the turbine fan blade to drive the piston to rotate at a low frequency through the air pipe.

* * * * *